US009157266B2

(12) United States Patent
Busch

(10) Patent No.: US 9,157,266 B2
(45) Date of Patent: Oct. 13, 2015

(54) METHOD FOR THE ARRANGEMENT OF A DRIVE UNIT IN A REVOLVING DOOR

(71) Applicant: Sven Busch, Dortmund (DE)

(72) Inventor: Sven Busch, Dortmund (DE)

(73) Assignee: Dorma Deutschland GmbH, Ennepetal (DE)

( * ) Notice: Subject to any disclaimer, the term of this patent is extended or adjusted under 35 U.S.C. 154(b) by 0 days.

(21) Appl. No.: 14/153,909

(22) Filed: Jan. 13, 2014

(65) Prior Publication Data

US 2014/0196375 A1 Jul. 17, 2014

(30) Foreign Application Priority Data

Jan. 14, 2013 (DE) ..... 10 2013 000 416

(51) Int. Cl.
*E05F 15/10* (2006.01)
*E06B 11/08* (2006.01)
*E05F 15/608* (2015.01)

(52) U.S. Cl.
CPC ..... *E05F 15/106* (2013.01); *E05F 15/608* (2013.01); *E06B 11/08* (2013.01); *E05Y 2800/106* (2013.01); *E05Y 2900/132* (2013.01)

(58) Field of Classification Search
CPC ..... E05Y 2900/132; E06B 3/90; E06B 11/08; E05F 15/106
USPC ..... 49/42–47
See application file for complete search history.

(56) References Cited

U.S. PATENT DOCUMENTS 2,007,213 A * 7/1935 Peremi et al. ..... 49/45
2,050,584 A * 8/1936 Peremi et al. ..... 49/43
2,119,550 A * 6/1938 Loughridge ..... 188/180
2,136,323 A * 11/1938 Shields ..... 362/147
2,186,385 A * 1/1940 Lockart ..... 292/33
2,341,545 A * 2/1944 Hagenbook ..... 49/42
2,523,980 A * 9/1950 Whiteford ..... 49/44
3,349,876 A * 10/1967 Sheckells ..... 188/185
3,364,620 A * 1/1968 Hess et al. ..... 49/43
3,736,701 A * 6/1973 Rush et al. ..... 49/44
3,766,686 A * 10/1973 Sheckells ..... 49/43
3,897,651 A * 8/1975 Sheckells ..... 49/43
4,332,108 A * 6/1982 Appelmann ..... 49/44
4,341,165 A * 7/1982 Calandritti et al. ..... 109/8
4,358,909 A * 11/1982 Trikilis ..... 49/42
4,458,447 A * 7/1984 Heise et al. ..... 49/44
4,557,073 A * 12/1985 Sandling ..... 49/41
4,627,193 A * 12/1986 Schwarz ..... 49/42
4,660,322 A * 4/1987 Lowe ..... 49/44
4,763,053 A * 8/1988 Rabe ..... 318/400.41
4,874,975 A * 10/1989 Hertrich ..... 310/186
4,970,825 A * 11/1990 Knarvik ..... 49/44
4,976,065 A * 12/1990 Beran et al. ..... 49/43
5,634,295 A * 6/1997 Bunzl ..... 49/45
5,773,943 A * 6/1998 Andersen ..... 318/432

(Continued)

FOREIGN PATENT DOCUMENTS

EP 2 072 737 A2 6/2009

*Primary Examiner* — Katherine Mitchell
*Assistant Examiner* — Justin Rephann
(74) *Attorney, Agent, or Firm* — Cozen O'Connor

(57) ABSTRACT

A method for arranging a drive unit in a revolving door, the drive unit being arranged at a ceiling element of the revolving door and configured to drive a turnstile of the revolving door, includes: arranging an adapter element at the ceiling element; arranging an electronically commutated multipole motor at an adapter element; and adjusting, by the adapter element, the multipole motor relative to the turnstile of the revolving door.

9 Claims, 2 Drawing Sheets

(56) References Cited

U.S. PATENT DOCUMENTS

| | | | | |
|---|---|---|---|---|
| 5,825,901 | A * | 10/1998 | Hisey | 381/165 |
| 6,266,922 | B1 * | 7/2001 | Rockenbach | 49/42 |
| 8,136,297 | B2 * | 3/2012 | Bzorgi | 49/43 |
| 2005/0241234 | A1 * | 11/2005 | Ginzel | 49/42 |
| 2008/0047200 | A1 * | 2/2008 | Krause et al. | 49/31 |
| 2008/0244978 | A1 * | 10/2008 | Soyugenc | 49/42 |
| 2009/0188166 | A1 * | 7/2009 | Taheri et al. | 49/31 |
| 2009/0189560 | A1 * | 7/2009 | Taheri et al. | 318/445 |
| 2009/0206777 | A1 * | 8/2009 | Taheri et al. | 318/15 |
| 2012/0005961 | A1 * | 1/2012 | Busch et al. | 49/46 |

* cited by examiner

METHOD FOR THE ARRANGEMENT OF A DRIVE UNIT IN A REVOLVING DOOR

BACKGROUND OF THE INVENTION

1. Field of the Invention

The present invention is directed to a method for the arrangement of a drive unit in a revolving door, wherein the drive unit is arranged at a ceiling element of the revolving door and serves to drive a turnstile of the revolving door.

2. Description of the Related Art

EP 2 072 737 A2 shows an arrangement of a drive unit in a revolving door, wherein the drive unit is arranged at a ceiling element of the revolving door. The method for arrangement includes arranging the drive unit, which is formed of a motor and a gear unit. The individual components of the drive unit are installed in an installation space in the ceiling of the revolving door after the frame of the revolving door has been installed and after the turnstile has been installed. As a rule, the components of the drive unit are located above a ceiling construction which upwardly terminates the receiving space for the turnstile in the revolving door. This brings about disadvantages with respect to accessibility of the drive unit so that, for example, maintenance work is also made more difficult. Special sealing steps are required in particular because assemblies installed on top are often exposed to atmospheric conditions. Further, there are cosmetic disadvantages with respect to the presentation of the revolving door because the installation height of conventional drive units in or above a ceiling element of the revolving door often exceeds 200 mm.

SUMMARY OF THE INVENTION

It is an object of the invention to provide a method for the simple arrangement of a drive unit in a revolving door, wherein the drive unit is to be arranged at a ceiling element of the revolving door.

This object is met, according to a first aspect of the present invention, by providing a method for the arrangement of a drive unit in a revolving door, wherein the drive unit is arranged at a ceiling element of the revolving door and serves to drive a turnstile of the revolving door, at least including the step of arranging an adapter element at the ceiling element, the step of arranging an electronically commutated multipole motor at an adapter element and adjusting the multipole motor relative to the turnstile of the revolving door by the adapter element.

Electronically commutated multipole motors can be gearlessly connected to the turnstile of the revolving door and arranged at a ceiling element of a revolving door in a simple manner by a flat, disk-shaped type of construction. As a result of the disk-shaped base structure of the multipole motor, a kind of rotary disk is formed, which can advantageously be arranged at the underside of the ceiling element and consequently can be positioned between the ceiling element and the turnstile of the revolving door. Accordingly, the multipole motor can serve at the same time as a ceiling-side bearing support of the turnstile.

Multipole motors are also known as torque motors and have coil elements which are basically arranged on a circular path and which are in an oppositely facing relationship, for example, on the inner side, outer side or axially, to magnet elements which are also arranged on a circular path so that a high-pole count, high-torque direct drive is formed.

Multipole motors can have a rotor part and a stator part. The stator part can be arranged so as to rest upon the adapter element, whereupon the rotor part can be connected to the turnstile of the revolving door. The rotor part and the stator part can each have a planar, flat portion, so that the portions are located opposite one another in a plane-parallel manner. The rotor part and/or the stator part can be disk-shaped and/or cup-shaped.

The arrangement, according to an aspect of the invention, of an adapter element between the multipole motor and the ceiling element, results in the advantage that the multipole motor can be adjusted at the ceiling element in a simple manner to align it relative to the turnstile of the revolving door. The adapter element forms a receiving unit for simple mounting, adjustment and alignment of the disk-shaped gearless multipole motor forming the drive unit for the revolving door. In addition, the adapter element allows the drive unit to be assembled and disassembled faster and, further, enables a convenient and precise alignment of the multipole motor.

In a particularly advantageous manner, there is provided, according to an aspect of the invention, a receiving unit for the multipole motor having a downwardly directed opening or mounting surface facing particularly in direction of the turnstile of the revolving door. The opening or mounting surface is large enough to allow the multipole motor to be mounted at the mounting surface through the opening without removing or dismantling other components of the revolving door. In particular, the ceiling construction of the revolving door can be completed before hand and the multipole motor can then be inserted thereafter in the opening in the ceiling.

In one aspect, the steps of arranging the adapter element at the ceiling element is carried out from the underside of the ceiling element, and the step of arranging the electronically commutated multipole motor is likewise carried out at the underside of the adapter element. This advantageously provides that the drive unit can be arranged completely below the load-carrying parts of the revolving door. By virtue of the arrangement under the supporting elements of the ceiling construction of the revolving door, the installation space required for the drive unit need not be taken into account in the design of the ceiling construction, and the execution of the ceiling construction is merely of secondary importance and need not be adapted to the arrangement of the drive unit. This makes it possible to simplify the technical design of the ceiling construction and to reduce production costs and assembly effort. Further, a retrofitting of revolving doors can be carried out with the inventive method for arrangement of the drive unit, and the space-saving arrangement of the multipole motor under the ceiling element by the adapter element can be adapted very easily in existing constructions because there is no need to consider available installation space within the ceiling construction.

In one aspect, the adjustment of the multipole motor can be carried out in one or more spatial directions and angular positions. In particular, the output shaft of the multipole motor can be aligned with the rotational axis of the turnstile.

According to one aspect of the present invention, after the step of adjusting the multipole motor relative to the turnstile of the revolving door by the adapter element, the step of final fastening of the multipole motor to the adapter element can be carried out after the adjustment between multipole motor and adapter element has been carried out. It is also possible to adjust the multipole motor relative to the turnstile of the revolving door between the adapter element and the ceiling element while the multipole motor is rigidly arranged at the adapter element. Finally, irrespective of the embodiment form of the adjustment of the multipole motor relative to the turnstile, there can follow the step of rigidly arranging the multipole motor also relative to the ceiling element so that the multipole motor is definitively fastened to the ceiling element by one or more appropriate fasteners. This advantageously provides that the multipole motor can also not be misadjusted by itself through vibrations of the drive unit during the operation of the revolving door because the multipole motor has been secured to the ceiling element by one or more corresponding fasteners.

According to an advantageous further development of the method, this method can be supplemented by the step of gearlessly connecting the electronically commutated multipole motor to the turnstile of the revolving door, in particular to the revolving wings of the turnstile. If the multipole motor is aligned relative to the turnstile, which can already be positioned in the frame of the revolving door without being directly connected to the multipole motor, the connection to the revolving wings of the turnstile can be carried out after the adjustment of the multipole motor. For example, the revolving wings of the turnstile can be connected to the rotor part of the multipole motor by screws.

In another aspect, the method can further include the step of pre-mounting the multipole motor to the adapter element by corresponding one or more pre-fixing portions after the adapter element has already been arranged at the ceiling element. The pre-fixing portions make it possible to preposition and pre-fix the drive unit first in a simple manner before final mounting, adjustment and fixing. This can be carried out, for example, by clips, snaps or by a bayonet fastener. The pre-fixing portions can comprise spring-loaded snaps which are guided through openings in the drive unit in order to hold the drive unit at the adapter element by positive engagement. It is also possible to form the pre-fixing portions by mushroom head elements which can be guided through keyhole-shaped openings in the drive unit and, by a slight angular rotation of the drive unit, the drive unit can be held by the mushroom head elements. A particular advantage of prefixing portions of this kind consists in that the pre-fixing process can be performed without tools and pre-fixing can accordingly be carried out by one person by overhead mounting.

In another aspect, a further advantage is achieved in that the adapter element and the multipole motor are mounted at the ceiling element from a common mounting direction; in particular, the mounting direction coincides with the rotational axis of the turnstile. The adapter element and the multipole motor can be mounted at the ceiling element from below so that mounting is carried out from the space in which the turnstile is next inserted and can rotate. For example, the multipole motor can be pre-fixed to the insert the turnstile into the frame of the revolving door subsequently. Next, the multipole motor is adjusted relative to the turnstile and, finally, in a last step, the multipole motor is connected with the turnstile. An adjustment of the multipole motor can be carried out also without the turnstile having already been inserted in the frame of the revolving door. For example, the rotational axis of the turnstile can be identified by a plumb line so that the adjustment of the multipole motor is oriented to the rotational axis of the turnstile without the turnstile itself needing to be inserted already in the frame of the revolving door. Alternatively, however, the method can provide that the turnstile is already arranged at the multipole motor, for example, so as to be movable, before adjusting the multipole motor at the ceiling element by the adapter element and the multipole motor is not connected to the turnstile definitively for later operation until after being adjusted.

In another aspect of the invention, the adapter element can have one or more adjusting portions, and the adjustment of the drive unit relative to the turnstile of the revolving door is carried out by one, but preferably two or more, adjusting portions. The adjusting portions can be formed, for example, by rubbery-elastic elements which can be elastically deformed variably in respective connection with a screw element. As an alternative to rubbery-elastic elements, spring elements, for example, spiral springs or helical springs, can also be used. In particular, a further advantage is achieved in that the adjusting portions can be constructed so as to form an integral constructional unit with the pre-fixing portions so that the pre-fixing portions can also be formed by the adjusting portions. For example, the adjusting portions can comprise snap hooks or can be supplemented by mushroom head elements, and the multipole motor can accordingly be prefixed to the adjusting portions and the multipole motor can subsequently be adjusted by the adjusting portions. Finally, the adjusting portions can also serve for final fixing of the multipole motor to the adapter element.

Finally, the method can include the step of arranging at least one under ceiling element to the adapter element. The adapter element can be constructed in a cup-shaped or disk-shaped manner and, in particular, in case of a cup-shaped construction, an external circumferential collar of the adapter element can be provided, in which or on which the under ceiling elements are mounted.

The present invention is further directed to the arrangement of a drive unit in a revolving door formed by the method described above. The arrangement is directed to a drive unit in a revolving door, wherein the revolving door has a ceiling element at which the drive unit is arranged and is connected to this ceiling element for driving a turnstile of the revolving door, wherein the drive unit comprises an electronically commutated multipole motor which is arranged at the ceiling element by an adapter element and which is gearlessly connected to the turnstile, wherein the adapter element is formed for adjusting the multipole motor relative to the turnstile of the revolving door. The features and advantages of the arrangement of the drive unit in the revolving door by the adapter element, which were described above in connection with the method, are also taken into consideration for the arrangement of the drive unit.

In particular, the adapter element can have one or more pre-fixing portions by which the multipole motor can be pre-fixed to the adapter element. The adapter element can also have one or more adjusting portions that serve to adjust the drive unit relative to the turnstile of the revolving door. The adjusting portions can be constructed in such a way that it is possible to adjust the multipole motor relative to the adapter element, or the adjusting portions are constructed in such a way that the adapter element can be adjusted relative to the ceiling element while the multipole motor is rigidly arranged at the adapter element.

In a further advantageous manner, at least one under ceiling element can be arranged at the adapter element. For this purpose, the adapter element can have corresponding structure for receiving under ceiling elements. In particular, the adapter element can be constructed in a cup-shaped manner and can have a collar, and the at least one under ceiling element can be engaged behind the collar.

In a further advantageous manner, an illumination device can be provided which is arranged at the adapter element and/or at the multipole motor itself. The illumination device can be constructed in such a way, for example, that it annularly surrounds the multipole motor. Accordingly, the walk-in area inside the turnstile of the revolving door can be illuminated and the annularly formed illumination device can completely illuminate the area around the rotational axis of the turnstile.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the following, further steps improving the invention are explained in more detail in connection with the description of preferred exemplary embodiments of the invention with reference to the drawings. In the drawings.

DETAILED DESCRIPTION OF THE PRESENTLY PREFERRED EMBODIMENTS

Figure 1:
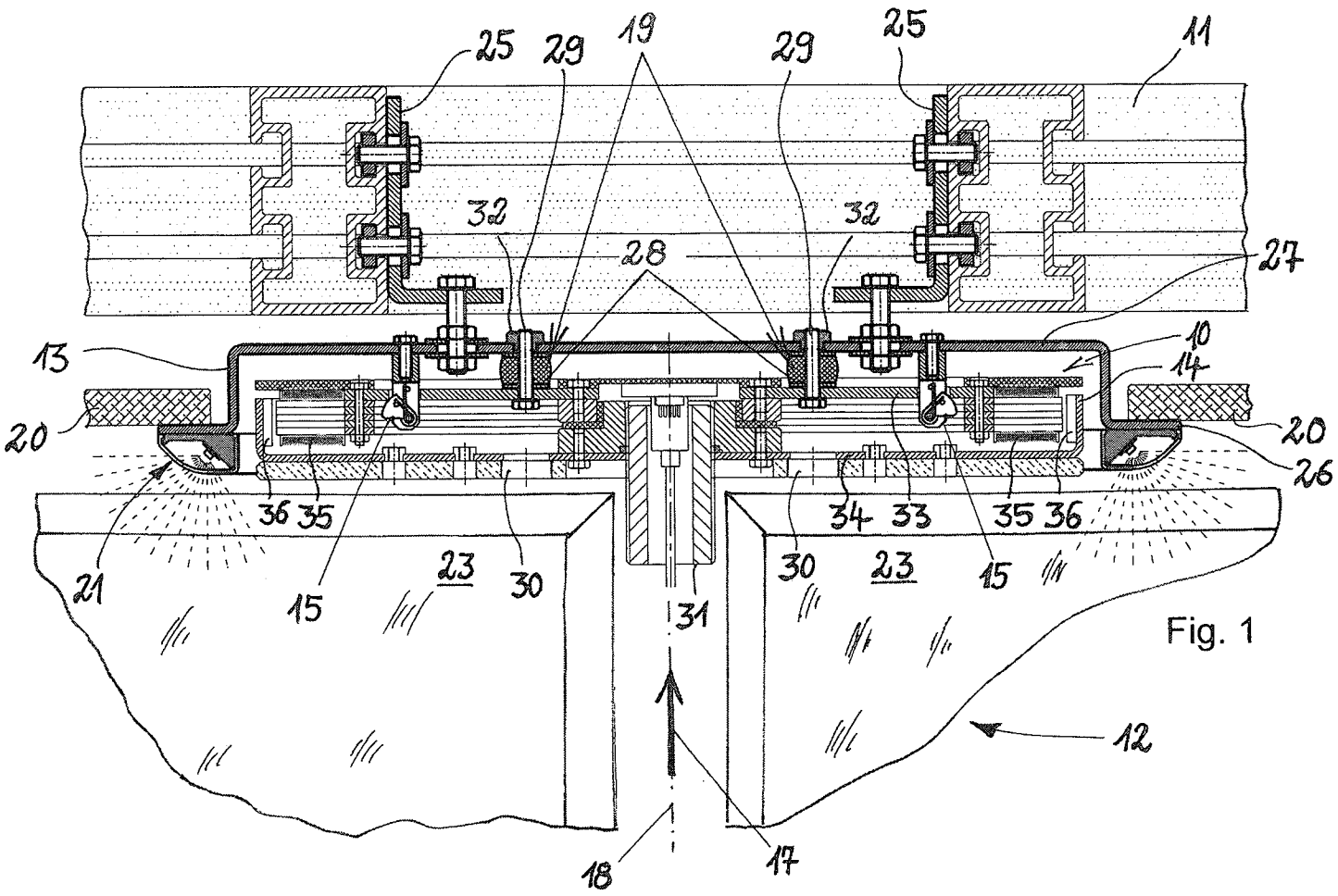
FIG. 1 is a cross-sectional view showing an exemplary embodiment of an arrangement of a drive unit at a ceiling element of a revolving door with an adapter element according to a first constructional variant.

FIG. 1 shows a first exemplary embodiment of the arrangement of a drive unit 10 at a ceiling element 11 of a revolving door. The ceiling element 11 is formed, for example, by metallic profile elements, which form a supporting base structure in the ceiling area of the revolving door. A turnstile 12, which is formed of two revolving wings 23, for example, is shown below the ceiling element 11.

An adapter element 13 is secured to the underside of the ceiling element 11. The fastening is shown, for example, by angle elements 25, and the adapter element 13 is cup-shaped and has a collar-shaped circumferential edge 26. The base area 27 of the adapter element 13 forms an installation opening at the ceiling of the revolving door, which installation opening faces downward in direction of the turnstile 12 and is bounded along its periphery by the circumferential edge 26.

Located on the underside of the ceiling element 11 are under ceiling elements 20, which are hooked into the collar-shaped circumferential edge 26 and, for example, form a camouflaging for the ceiling element 11. Consequently, the adapter element 13 can be arranged with the under ceiling elements 20 already below the ceiling element 11 so as to form an installation opening for the subsequent installation of the drive unit 10, which is formed by an electronically commutated multipole motor, this installation opening being defined by the circumferential edge 26 and the base area 27 of the adapter element 13.

The multipole motor 14 has a disk-shaped, flat extension and the installation opening for the multipole motor 14 is dimensioned in such a way by the adapter element 13 that the multipole motor 14 can be inserted into the installation opening. For this purpose, a person performing the assembly can arrange the multipole motor 14 at the adapter element 13 from the mounting direction 17 that coincides with the rotational axis 18 of the turnstile 12. The arrangement can initially consist in a pre-fixing of the multipole motor 14 to the adapter element 13, pre-fixing portions 15 being provided for this purpose. The multipole motor 14 is shown in an arrangement in which it is locked at the pre-fixing portions 15, and the pre-fixing portions 15 have, for example, snap hooks that engage behind openings in the multipole motor 14 so that the latter can be pre-fixed overhead in the adapter element 13 so as to be securely held by a person performing the assembly.

Adjusting portions 19 comprising elastic elements 28 and screw elements 29, are arranged between the multipole motor 14 and the adapter element 13.

After pre-fixing the multipole motor 14 at the pre-fixing portions 15, a person performing the assembly can adjust the screw elements 29 of the adjusting portions 19 with a tool through tool openings 30 in the multipole motor 14 so that the position of the multipole motor 14 changes relative to the adapter element 13. In particular, the multipole motor 14 can be aligned in its two-dimensional extension with respect to the turnstile 12 so that the axis of rotation 18 of the output shaft 31 of the multipole motor 14 can align with the rotational axis 18 of the turnstile 12.

By further fastening structure, not shown in more detail, the multipole motor 14 can be definitively secured to the adapter element 13 in the adjusted position for subsequent operation in the revolving door. However, it is possible to operate the multipole motor 14 over the long term already by the arrangement by the adjusting portions 19 at the adapter element 13. The advantage brought about in this way is that the multipole motor 14 is elastically suspended by the above-described construction of the adjusting means 19; in particular, elastic receiving elements 32 are shown, which likewise allow the multipole motor 14 to be received at the adapter element 13 in a damping manner.

The multipole motor 14 has a stator part 33 and a rotor part 34, and the stator part 33 is secured to the adapter element 13 by the adjusting means 19. The revolving wings 23 of the turnstile 12 are secured to the rotor part 34 in a manner not shown in more detail. Coil elements 35 and magnet elements 36 are positioned between the stator part 33 and the rotor part 34, and a torque can be generated between the rotor part 34 and the stator part 33 by a corresponding electronic commutation of the current supply of the coil elements 35 and magnet elements 36. The magnet elements 36 are located on the outer side with respect to the coil elements 35 so that the multipole motor 14 is constructed in the manner of an external rotor.

The exemplary embodiment further shows an illumination device 21, which is formed annularly and is arranged, for example, at the collar-shaped circumferential edge 26 of the adapter element 13. Because of the annular construction of the illumination device 21, the latter surrounds the multipole motor 14 and enables an illumination of the walk-in area of the revolving door.

Figure 2:
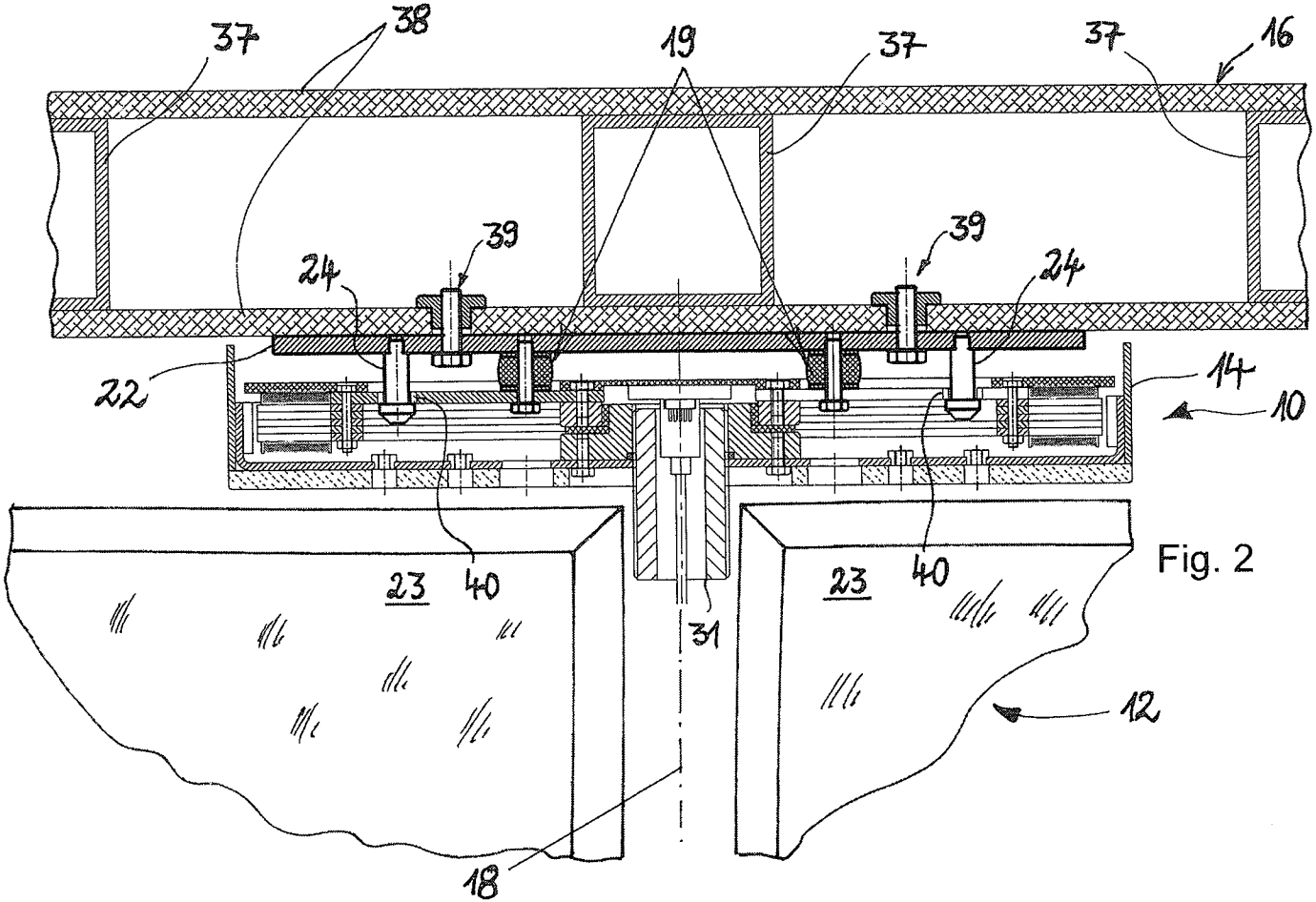
FIG. 2 is a cross-sectional view an exemplary embodiment of an arrangement of a drive unit at a ceiling element of a revolving door with an adapter element according to a further constructional variant.

FIG. 2 is a cross-sectional view of a further arrangement of a drive unit 10 at a ceiling element 16 of a revolving door. The ceiling element 16 has profile elements 37, cover panels 38 being arranged at the top and bottom thereof. At least the bottom cover panel 38 can already have a decorative surface so that no further under ceiling elements need be arranged at the ceiling element 16.

An adapter element 22 is arranged on the underside of the bottom cover panel 38 of the ceiling element 16 by fasteners 39; the adapter element 22 is constructed as a planar adapter disk. Pre-fixing portions 24, which are constructed as mushroom head elements project out of the extension plane of the adapter element 22 and engage in receiving openings 40 in the multipole motor 14. The receiving openings 40 can be keyhole-shaped so that the mushroom head of the pre-fixing portions 24 initially fits through the opening and, after subsequent rotation of the multipole motor 14, the mushroom heads of the pre-fixing portions 24 can engage behind the receiving openings 40 by positive engagement so that the multipole motor 14 can be arranged at the adapter element 22 in a self-retaining manner by one person without using a tool.

After pre-fixing the multipole motor 14 to the adapter element 22, adjusting portions 19 can be arranged, by which the multipole motor 14 can be aligned at the adapter element 22 in particular so as to bring about the alignment of the output shaft 31 of the multipole motor 14 relative to the rotational axis 18 of the turnstile 12. In so doing, the adjusting portions 19 can form fasteners at the same time so that the multipole motor 14 is already adapted by the adjusting portions 19 for subsequent operation in the revolving door.

The invention is not limited with respect to its construction to the preferred embodiment example indicated in the preceding. On the contrary, there are a number of conceivable variants which can be made use of by the demonstrated solution also in fundamentally different arrangements. All of the features and/or advantages, including constructional details or spatial arrangements, stemming from the claims, the description or the drawings may be essential to the invention both by themselves and in the most widely varying combinations. Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for installing a drive unit (10) in a ceiling element (11, 16) of a revolving door, the ceiling element (11, 16) of the revolving door being configured to receive and engage the drive unit (10), the drive unit being configured to drive a turnstile (12) of the revolving door, the method comprising:

securing an adapter element (13, 22) to an underside of the ceiling element (11, 16);

securing an electronically commutated multipole motor (14) having an output shaft (31) and tooling openings (30) to the adapter element (13, 22); and adjusting, by one or more adjusting portions (19) of the adapter element (13, 22), alignment of the output shaft (31) of the multipole motor (14) relative to a rotational axis (18) of the turnstile (12) of the revolving door, the one or more adjusting portions (19) being accessed for the adjusting via the tool openings (30).

2. The method according to claim 1, further comprising gearlessly connecting the output shaft (31) of the electronically commutated multipole motor (14) to revolving wings (23) of the turnstile (12) of the revolving door.

3. The method according to claim 1, further comprising a step, prior to the step of securing an adapter element (13, 22), of securing, by a pre-fixing portion (15, 24), the multipole motor (14) to the adapter element (13, 22).

4. The method according to claim 1, wherein the adapter element (13, 22) and the multipole motor (14) are mounted, with respect to one another, along a common mounting direction (17), the common mounting direction (17) coinciding with the rotational axis (18) of the turnstile (12).

5. The method according to one claim 1, further comprising providing at least one under ceiling element (20) under the ceiling element (11, 16), the under ceiling element being secured to the adapter element (13).

6. A system in which a drive unit (10) is arranged in a revolving door, the revolving door having a ceiling element (11, 16) configured to receive and engage the drive unit (10), the drive unit (10) being connected to the ceiling element (11, 16) so as to drive a turnstile (12) of the revolving door, the system comprising:

the drive unit (10), the drive unit (10) having an electronically commutated multipole motor (14) having an output shaft (31) and tool openings (30), the multipole motor (14) being arranged at the ceiling element (11, 16) and gearlessly connected to the turnstile (12); and an adapter element (13, 22) configured to:

(i) secure the electronically commutated multipole motor (14) at the ceiling element (11, 16), and (ii) adjust, by one or more adjusting portions (19) of the adapter element (13, 22), alignment of the output shaft (31) of the multipole motor (14) relative to a rotational axis (18) of the turnstile (12) of the revolving door, the one or more adjusting portions (19) being configured to be accessible for the adjusting via the tool openings (30).

7. The system according to claim 6, wherein the adapter element (13, 22) has one or more pre-fixing portions (15, 24) configured to mount the multipole motor (14) to the adapter element (13).

8. The system according to claim 4, further comprising at least one under ceiling element (20) under the ceiling element (11, 16), the under ceiling element being secured to the adapter element (13).

9. The system according to claim 6, further comprising an illumination device arranged at at least one location selected from a group of locations consisting of at the adapter element and at the multipole motor, the illumination device annularly surrounding the multipole motor.

* * * * *